US006186038B1

(12) United States Patent
Lastovich et al.

(10) Patent No.: US 6,186,038 B1
(45) Date of Patent: Feb. 13, 2001

(54) BAGEL SLICER

(75) Inventors: Mark S. Lastovich, Rockford; Perry R. DeYoung, Grand Rapids; Scott D. Sikkema, East Grand Rapids, all of MI (US)

(73) Assignee: Oliver Products Company, Grand Rapids, MI (US)

( * ) Notice: Under 35 U.S.C. 154(b), the term of this patent shall be extended for 0 days.

(21) Appl. No.: 09/070,583

(22) Filed: Apr. 30, 1998

(51) Int. Cl.[7] ..... B26D 3/30

(52) U.S. Cl. ..... 83/870; 83/454; 83/465; 83/762; 83/932; 269/54.5; 269/87.2

(58) Field of Search ..... 83/454, 762, 870, 83/761, 763, 764, 765, 452, 465, 932; 269/87.2, 54.5; D7/673

(56) References Cited

U.S. PATENT DOCUMENTS

| | | | | |
|---|---|---|---|---|
| 179,934 | | 7/1876 | Merwin | 83/762 |
| D. 299,995 | | 2/1989 | Rainville et al. | D7/673 |
| D. 316,657 | | 5/1991 | Mulherin | D7/673 |
| 1,146,098 | * | 7/1915 | Priestly | 269/87.2 |
| 1,602,573 | | 10/1926 | Craig | 83/409 |
| 1,702,144 | | 2/1929 | Weston | 269/302.1 |
| 1,866,960 | | 7/1932 | Zimmer | 83/762 |
| 2,206,154 | | 7/1940 | Bixler | 83/762 |
| 2,477,493 | * | 7/1949 | Olson | 83/454 X |
| 2,816,588 | | 12/1957 | Miron | 83/761 |
| 2,978,809 | | 4/1961 | Dunnet | 83/145 |
| 2,978,810 | | 4/1961 | Dunnet | 83/157 |
| 2,978,811 | | 4/1961 | Dunnet | 83/157 |
| 2,992,667 | | 7/1961 | Burrows | 269/54.5 |
| 3,018,806 | * | 1/1962 | Moore | 83/762 X |
| 3,199,860 | * | 8/1965 | Moberg | 269/87.2 |
| 3,318,352 | | 5/1967 | Seltzer | 269/288 |
| 3,347,296 | | 10/1967 | Rothman | 269/87.2 |
| 3,596,354 | | 8/1971 | Emerson | 83/451 |
| 3,821,061 | | 6/1974 | Schier | 269/54.5 |
| 3,837,775 | | 9/1974 | Boucher | 425/195 |
| 3,987,541 | | 10/1976 | Sieczkiewicz | 30/114 |
| 3,995,844 | | 12/1976 | Hellman | 269/54.5 |
| 4,125,046 | | 11/1978 | Kroh et al. | 83/457.2 |
| 4,399,989 | | 8/1983 | Baillie | 269/87.2 |
| 4,747,331 | | 5/1988 | Policella | 83/762 |
| 4,807,505 | | 2/1989 | Campbell et al. | 83/454 |
| 5,228,668 | | 7/1993 | Guyer | 269/87.2 |
| 5,291,815 | | 3/1994 | Reifenhauser | 83/837 |
| 5,361,666 | | 11/1994 | Kensrue | 83/870 |
| 5,386,755 | | 2/1995 | Schneider et al. | 83/762 |
| 5,431,078 | | 7/1995 | Ricard et al. | 83/870 |
| 5,577,430 | | 11/1996 | Gunderson et al. | 83/870 |
| 5,673,608 | * | 10/1997 | DeMars | 83/762 X |

FOREIGN PATENT DOCUMENTS

| | | |
|---|---|---|
| 15140 | 9/1891 | (GB) . |
| 2290218 | 12/1995 | (GB) . |

* cited by examiner

*Primary Examiner*—Clark F. Dexter
(74) *Attorney, Agent, or Firm*—Price Heneveld Cooper DeWitt & Litton

(57) ABSTRACT

A bagel slicer generally comprising a base, a flexible connector, a lid and a knife. The base has upwardly projecting bagel retention protrusions and two end walls attached to opposing ends of the base which define a bagel receiving space. Between the walls there is a first plurality of elongated side members in a parallel spaced relationship to each other, and a second plurality of elongated side members in a parallel spaced relationship to each other and to the first plurality of elongated side members. Each elongated member is engaged with the walls such that there remains slots between them to insert a knife. A flexible connector is attached to the lid and one of the walls. The flexible connector allows the lid to be shiftable angularly away from or toward the bagel receiving space to facilitate removal or insertion of the bagel into the space, and to shift directly vertically for optimum engagement with bagels of different thicknesses to contact a substantial portion of the bagel for optimum stabilization of the bagel.

12 Claims, 3 Drawing Sheets

BAGEL SLICER

BACKGROUND OF THE INVENTION

This invention relates generally to a device for slicing and/or skinning of food products, particularly bagels. A number of machines and devices for slicing bagels have been proposed in the prior art. These generally have a receptacle where the bagel is held vertically, and the bagel holder contains a pair of opposed slots or grooves into which a cutting instrument is inserted and moved back and forth in a sawing action to slice the bagel. In some cases the receptacle contains multiple opposed slots for making multiple slices. Due to the movement of the bagel back and forth caused by the sawing of the knife, and the resulting damage to the bagel, some prior art taught the use of tapered walls, moveable side doors, or pivotally connected sides which would be closed in efforts to hold the bagel stationary and prevent damage to the bagel while being sliced. In commercial settings, such as restaurants and delicatessens, speed, safety, cleanliness, uniform bagel slicing or skinning, and a minimum amount of space required to use the device are all desired. However, as far as is known, a bagel slicer having these characteristics as well as the capacity of being economically manufactured has not been available and accepted in the trade.

SUMMARY OF THE INVENTION

Accordingly, one of the objectives of the invention is to provide a device which allows bagels and the like to be sliced and/or skinned uniformly, quickly, and safely.

Another object of the invention is to provide an improved bagel slicer using a minimum of space, and which facilitates even slicing while preventing damage to the bagel.

Another object of the invention is to provide a bagel slicer which only requires the operator to operate the inserted knife once the bagel is inserted into the retention area of the device and the lid is closed, further facilitating safety, speed, and ease of use.

The invention comprises a base with upwardly projecting bagel retention protrusions and two vertical end walls attached to opposing ends of the base and extending upwardly from the base. There are two sets of elongated members, the members of each set being in a parallel spaced relationship to each other, and the members of one set being spaced from and parallel to the elongated members of the other set. Each elongated member is engaged at the end walls such that there remains a slot between at least two elongated members necessary to insert a knife. The bagel slicer has a flexible connector attached to a lid and one of the end walls. The flexible connector allows the lid to engage a substantial portion of the top of the bagel despite varying bagel thicknesses, to optimize bagel stabilization. Preferably, the lid will have downwardly projecting bagel retention protrusions that work in conjunction with the upwardly projecting protrusions on the base to provide extra stabilization of the bagel without damage to the bagel during cutting. For additional ease of use, the lid may also have a handle attached to it to facilitate opening and closing of the lid.

These and other features, advantages and objects of the present invention will be further understood and appreciated by those skilled in the art by reference to the following specification, claims and appended drawings.

BRIEF DESCRIPTION OF THE DRAWINGS

The figures in the drawings are briefly described as follows.

DETAILED DESCRIPTION OF PREFERRED EMBODIMENTS

Figure 1:
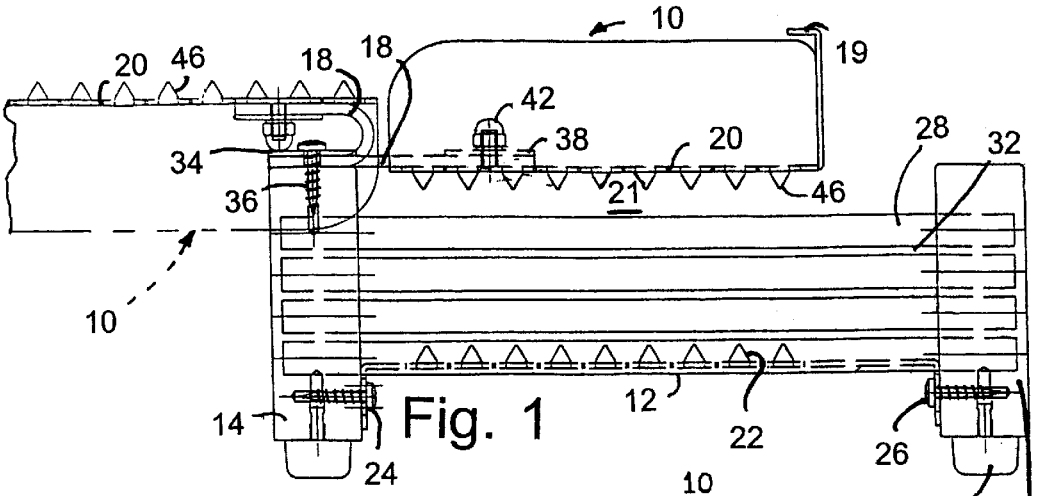
FIG. 1 is the side elevational view of a first embodiment of the invention, shown with the lid in two alternate, i.e., open and closed, positions.
Figure 2:
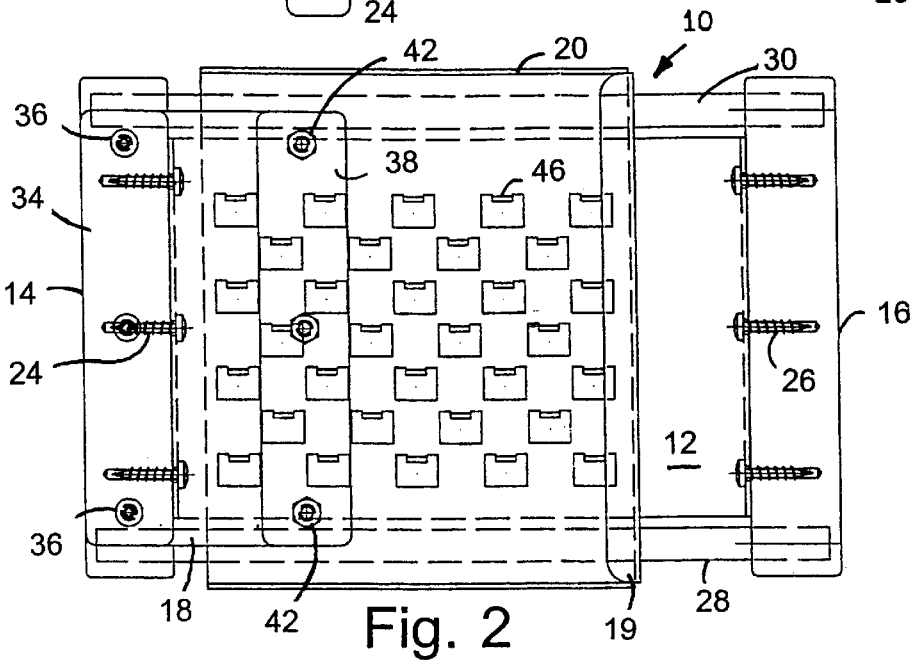
FIG. 2 is a plan view of the first embodiment of the invention with the lid in closed position.
Figure 3:
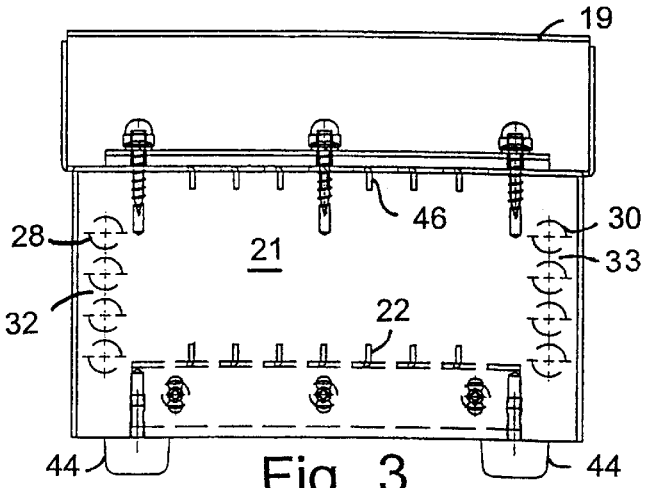
FIG. 3 is an end elevational view of the first embodiment of the invention.

The relative terms vertically and horizontally are used herein for convenience to designate the orientation of components of the invention in the position in which it is preferably employed. However, it is to be understood that the novel slicer can be placed in alternative positions/orientations so that these terms should be treated accordingly.

The preferred form of the present invention is a bagel slicing device 10 which includes a base or bottom plate 12 connected at its opposite ends to two upstanding polymeric end walls 14 and 16 by self threading fasteners 24 and 26 extending through downwardly extending end flanges on bottom 12. Extending between and into sockets of end wall 14 and 16 are pluralities of metal members in the form of rods 28 on one side and 30 on the opposite side. Rods 28 are vertically spaced from each other and are parallel to each other, here shown to be four in number and forming three elongated slots 32 therebetween. Rods 30 are a duplicate of rods 28, to form three like slots 33 aligned with slots 32 between rods 28 to receive an elongated knife blade. The slots are located varying distances above bottom plate 12.

The base 12 is preferably made of a metal plate stamped to form a plurality of upwardly projecting, triangular bagel retention protrusions 22 in a pattern over its surface and adjacent openings. End walls 14 and 16 and rods 28 and 30 define a bagel retention space 21 therebetween.

At the top of the bagel receiving space is a lid 20 which extends over at least a majority of space 21. The lid is flexibly attached to end 14 by a strip 18 of flexible, elastomeric, polymeric material, preferably rubber. Fasteners 36 and elongated reinforcing plate 34 attach one end of strip 18 to end wall 14. Fasteners 42 and elongated reinforcing plate 38 attach the other end of strip 18 to lid 20. A handle 19 located on lid 20 at the distal end, i.e., opposite where the lid 20 is attached to wall 14, allows the operator to easily shift lid 20 away from or toward space 21, enabling easy insertion and removal of a bagel. Lid 20 has a plurality of downwardly projecting triangular protrusions 46 extending into space 21 opposite bottom protrusions 22, to retain a bagel in space 21. The protrusions and adjacent openings may be formed into lid plate 20 as by stamping. Flexible connector 18 not only enables lid 20 to be moved through an angle approaching 180°, but also enables some direct vertical displacement of lid 20 to accommodate bagels of different thicknesses. Thus, it allows lid 20 to contact a substantial portion of the bagel surface despite varying bagel thickness and shape, to optimize bagel stabilization.

Figure 4:
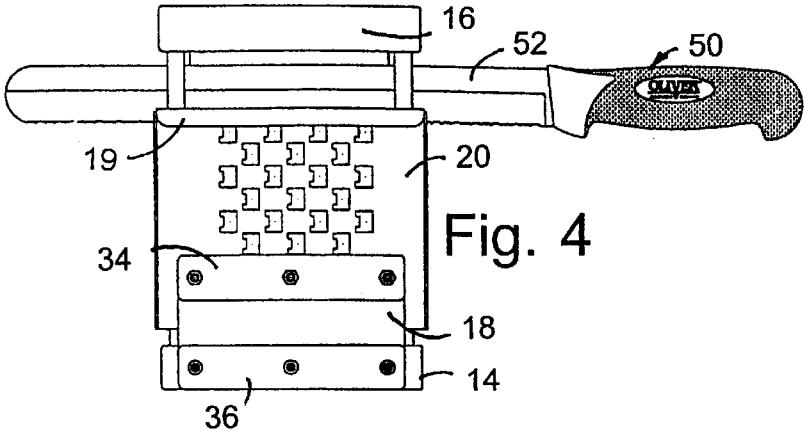
FIG. 4 is a plan view of the invention, showing the position of a cutting knife at the beginning of the cut.

Optionally, rubber feet 44 may be provided on the lower ends of walls 14 and 16 of the device 10. The feet 44 may be attached (FIG. 4) at the bottom of the walls 14, 16, as with screws.

To use the bagel slicing device 10, the operator grasps handle 19 and angularly shifts the lid up and away from the bagel retention space 21 by flexing flexible connector 18. The operator then inserts a bagel into bagel retention space 21, on top of upwardly projecting bagel retention protrusions 22. Next, the operator closes lid 20 by shifting lid 20 angularly back toward the bagel, the flexible connector also allowing direct vertical movement of the lid sufficient for maximum engagement of its protrusions 46 with the top of the bagel. After the bagel is secure, the operator can then either slice the bagel into two halves by using the middle slot, and/or can skin the bottom or top of the bagel by inserting the knife blade 52 of knife 50 into the bottom or top slots. The operator inserts the knife through a selected slot 32 and across space 21 through the opposite slot 33 aligned with slot 32. The knife blade has parallel side faces, with the sharp lateral edge spatially located therebetween so as to not contact bars 28 and 30. The operator, using the elongated bars as a guide, moves the knife toward wall 14 in a back-and-forth slicing motion to cut the bagel evenly. If the knife edge contacts the end wall, the edge is not dulled because the end wall is soft. Once the bagel is sliced and/or skinned, the operator removes the knife from slots 32 and 33, grasps handle 19 of lid 20, shifts lid 20 away from the bagel retention space 21, and removes the sliced bagel.

Figure 5:
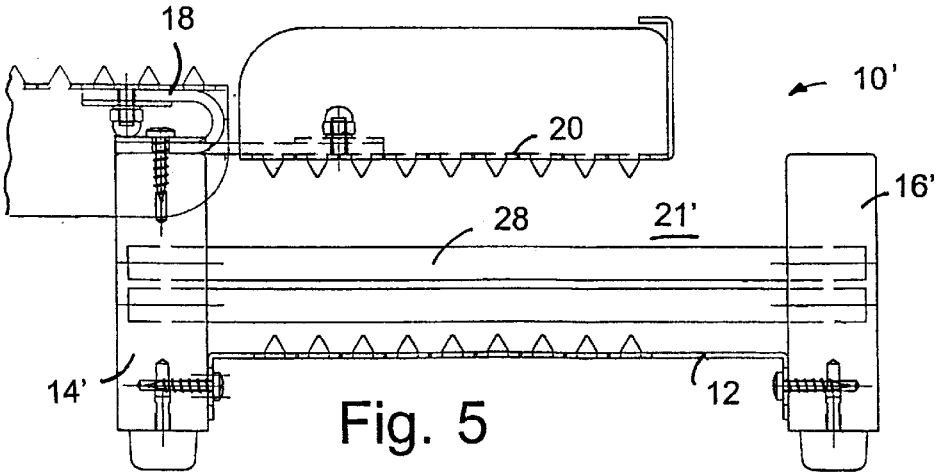
FIG. 5 is a side elevational view of an alternative embodiment of the invention.
Figure 6:
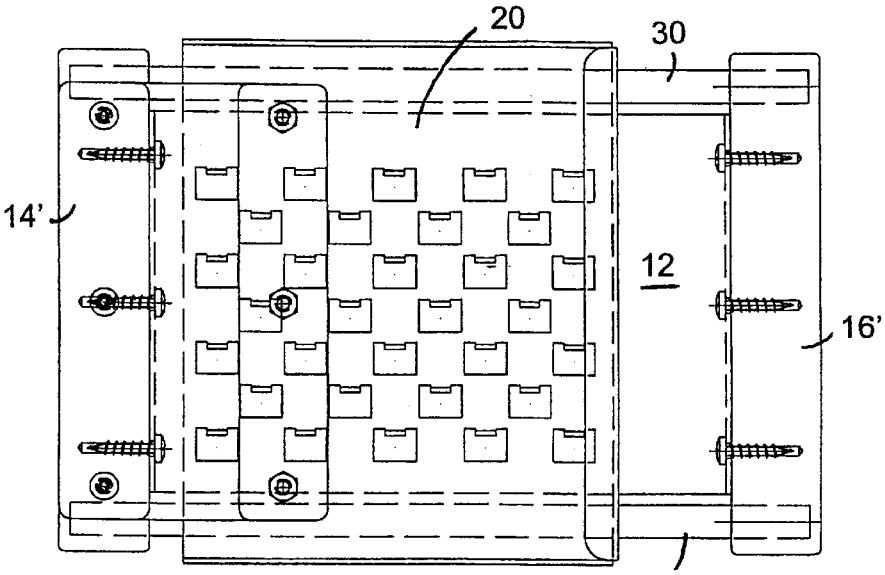
FIG. 6 is a plan view of the alternative embodiment of the invention.
Figure 7:
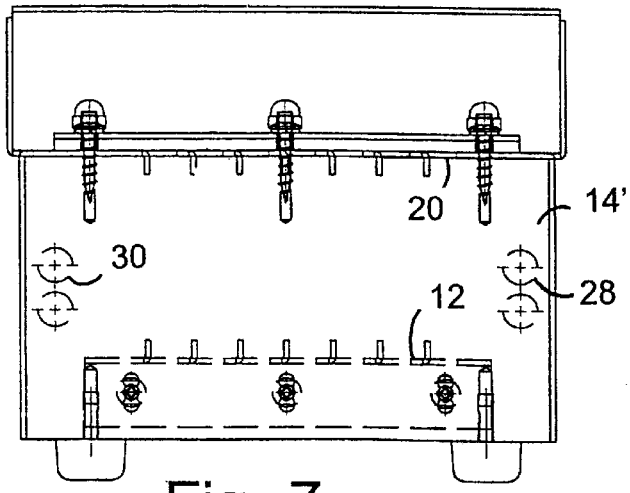
FIG. 7 is an end elevational view of the alternative embodiment.
Figure 8:
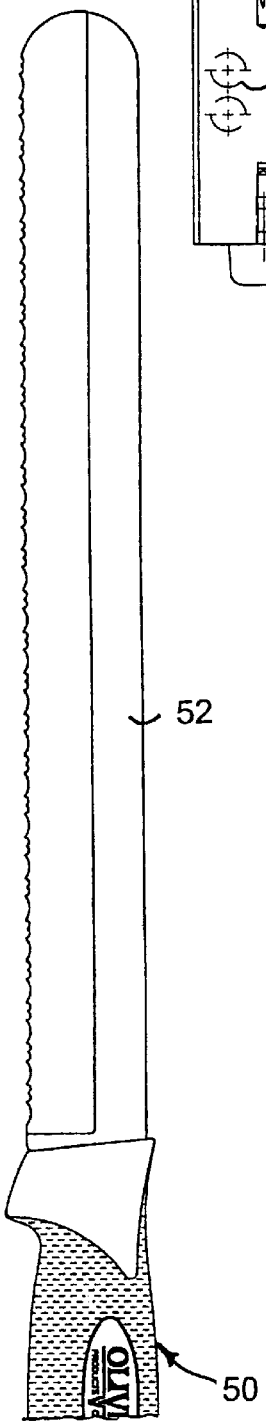
FIG. 8 is an elevational view of the preferred cutting knife.
Figure 9:
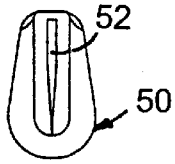
FIG. 9 is an end elevational view of the preferred cutting knife.

An alternative structure 10' (FIG. 5) is shown to include only two metal members in the form of rods 28 and 30 in each set, forming only one slot on each side of the device, for slicing the bagel in space 21'. The bottom plate 12, end walls 14' and 16' and lid subassembly 20 with flexible connector 18 are comparable to elements 12, 14, 16, 18 and 20 in the first embodiment. The use of knife 50 and its blade 52 is the same as previously described.

The above description is considered that of the preferred embodiments only. Modifications of the invention will occur to those skilled in the art and to those who make or use the invention. Therefore, it is understood that the embodiments shown in the drawings and described above are for illustrative purposes and not intended to limit the scope of the invention, which is defined by the following claims as interpreted according to the principles of patent law, including the doctrine of equivalents.

What is claimed is:

1. A bagel slicer comprising:

a base having a pair of opposite sides and a pair of opposite ends;

two walls attached to said opposite ends of said base and defining a bagel receiving space therebetween;

a first plurality of elongated members in parallel spaced relationship to each other extending between said walls and along one of said sides of said base, and a second plurality of elongated members in parallel spaced relationship to each other extending between said walls and along the other opposite side of said base, and parallel to said first plurality of elongated members;

said first and second plurality of elongated members defining at least one slot on each side of said space to receive a knife between said elongated members;

a lid shiftable away from or over said bagel receiving space to facilitate removal or insertion of a bagel into said space; and a flexible connector between and attached to said lid and to one of said walls, to enable said lid to be angularly shiftable away from or over said bagel receiving space to facilitate removal or insertion of the bagel into said space, and also to enable said lid to be vertically adjustable relative to said space to optimize engagement of said lid with the bagel.

2. The bagel slicer in claim 1, wherein said lid has a plurality of downwardly projecting bagel retention protrusions, and said base has upwardly projecting bagel retention protrusions, for stabilization of the bagel therebetween during cutting.

3. The bagel slicer in claim 2, wherein said flexible connector is of sufficient length to allow said lid to contact a substantial portion of the top of the bagel despite varying bagel thicknesses, to optimize bagel stabilization.

4. The bagel slicer in claim 1, wherein said flexible connector is a thin elastomeric material.

5. The bagel slicer in claim 4, wherein said elastomeric material is rubber.

6. The bagel slicer in claim 1, further comprising said lid having a handle.

7. The bagel slicer in claim 1, wherein said flexible connector has a pair of opposite edge portions, one of said edge portions being attached to said lid and the other of said edge portions being attached to said one of said walls.

8. The bagel slicer in claim 7, including reinforcing plates at said flexible connector opposite edge portions.

9. The bagel slicer in claim 1, wherein said walls each have a plurality of holes and said first and second plurality of elongated members have ends fitted in said holes.

10. The bagel slicer in claim 1 wherein said first and second plurality of elongated members each comprise four bars forming three slots therebetween for skinning and/or cutting bagels with said knife.

11. The bagel slicer in claim 1 wherein said first and second plurality of elongated members each comprise two bars forming a slot therebetween for cutting bagels with said knife.

12. The bagel slicer in claim 1 in combination with a slicing knife comprising a handle and an elongated blade, said blade having a pair of parallel side walls and a sharp lateral edge spatially located between said parallel side walls so as not to engage said elongated members of said slicer.

* * * * *

UNITED STATES PATENT AND TRADEMARK OFFICE

CERTIFICATE OF CORRECTION

PATENT NO. : 6,186,038 B1
DATED : February 13, 2001
INVENTOR(S) : Mark S. Lastovich et al.

It is certified that error appears in the above-identified patent and that said Letters Patent is hereby corrected as shown below:

Column 3,
Line 38, "plate 12" should be -- plate 12′ --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*